US011945645B2

(12) United States Patent
Gashi et al.

(10) Patent No.: US 11,945,645 B2
(45) Date of Patent: Apr. 2, 2024

(54) BICYCLE RACK, SINGLE BICYCLE RACK AND BICYCLE RACK SYSTEM

(71) Applicant: Canyon Bicycles GmbH, Koblenz (DE)

(72) Inventors: Yll Gashi, Mayen (DE); Chris Kurzer, Koblenz (DE)

(73) Assignee: Canyon Bicycles GmbH, Koblenz (DE)

( * ) Notice: Subject to any disclaimer, the term of this patent is extended or adjusted under 35 U.S.C. 154(b) by 170 days.

(21) Appl. No.: 17/242,765

(22) Filed: Apr. 28, 2021

(65) Prior Publication Data

US 2021/0339940 A1 Nov. 4, 2021

(30) Foreign Application Priority Data

Apr. 29, 2020 (DE) ..... 20 2020 102 401.9

(51) Int. Cl.

| | |
|---|---|
| ***B65D 85/68*** | (2006.01) |
| ***B65D 25/10*** | (2006.01) |
| *B65D 5/44* | (2006.01) |
| *B65D 5/50* | (2006.01) |
| *B65D 5/64* | (2006.01) |

(52) U.S. Cl.

CPC ..... *B65D 85/68* (2013.01); *B65D 25/10* (2013.01); *B65D 5/445* (2013.01); *B65D 5/5047* (2013.01); *B65D 5/643* (2013.01); *B65D 2585/6862* (2013.01)

(58) Field of Classification Search

CPC ..... B65D 2585/6862; B65D 5/643; B65D 5/5047; B65D 5/445; B65D 25/10; B65D 85/68; B62H 2700/005; B62H 3/10; B62J 23/00; B62J 19/00; A45C 13/02

USPC ..... 206/335

See application file for complete search history.

(56) References Cited

U.S. PATENT DOCUMENTS

| | | | | |
|---|---|---|---|---|
| 2,339,947 A * | 1/1944 | Reaume | B65D 85/68 206/335 |
| 3,929,225 A | 12/1975 | Locke et al. | |
| 4,469,224 A * | 9/1984 | Ritter | B65D 85/68 217/38 |
| 6,199,700 B1 * | 3/2001 | Yamamoto | B65D 5/5069 206/320 |
| 2017/0066588 A1 | 3/2017 | Schreiber et al. | |

FOREIGN PATENT DOCUMENTS

| | | |
|---|---|---|
| CN | 106347877 B | 4/2018 |
| DE | 29507186 U1 | 7/1995 |
| DE | 202015006608 U1 | 12/2016 |
| DE | 202018000945 U1 | 5/2019 |
| EP | 0720955 A1 | 7/1996 |

(Continued)

*Primary Examiner* — Steven A. Reynolds
(74) *Attorney, Agent, or Firm* — The Webb Law Firm

(57) ABSTRACT

A bicycle transport packaging which is in particular suitable for shipping bicycles includes a base body. The base body having four sides arranged all around. Two mutually opposite sides, i.e. an upper side and a lower side of the base body are open. For transport purposes, they are respectively closed by a separate cover element and a separate bottom element. According to the invention, in the area of the cover element a reinforcing element extending in particular over the overall length and width of the cover opening is provided.

17 Claims, 4 Drawing Sheets

(56) References Cited

FOREIGN PATENT DOCUMENTS

| | | | |
|---|---|---|---|
| EP | 0765823 | A1 | 4/1997 |
| EP | 2239210 | B1 | 7/2013 |
| JP | 12205571 | A | 8/1990 |
| JP | 2003321082 | A | 11/2003 |
| JP | 2009262975 | A | 11/2009 |
| JP | 3210642 | U | 6/2017 |

* cited by examiner

BICYCLE RACK, SINGLE BICYCLE RACK AND BICYCLE RACK SYSTEM

CROSS-REFERENCE TO RELATED APPLICATION

This application claims priority to German Patent Application No. 20 2020 102 401.9 filed Apr. 29, 2020, the disclosure of which is hereby incorporated by reference in its entirety.

BACKGROUND OF THE INVENTION

Field of the Invention

The invention relates to a bicycle transport packaging, in particular for shipping bicycles.

Description of Related Art

For shipping bicycles, different transport packagings, in particular transport cardboard boxes are known. Bicycle transport packagings which are in particular suitable for bicycle transport are known from DE 20 2015 006 608 and DE 50 2010 004 018, for example. These bicycle transport packagings, which are in particular cardboard boxes, are very well suited for reliable packaging and shipping of conventional bicycles, mountain bikes, racing bikes and the like via postal services or the like. In particular, the corresponding transport containers protect the bicycle against damage during shipping. The thus shipped bicycle is unpacked by the customer and finally assembled.

When shipping heavy bicycles, such as e-bikes, the transport cardboard boxes described in DE 20 2015 006 608 and DE 50 2010 004 018 are disadvantageous in that the preassembled heavy bicycle frame, in particular together with most of the attachment parts, must be lifted upwards out of the transport cardboard box. Alternatively, the bicycle cardboard box can be placed on its side such that the bicycle can be pulled out sideways. Thus unpacking the bicycle is cumbersome.

In particular for heavy bicycles, such as bicycles with an electric motor and a battery, a bicycle transport packing was developed, as described in DE 20 2018 000 945. Such a bicycle transport container comprises a cubically shaped base body comprising side elements arranged all around on four sides and is thus closed all around. On two opposite sides, i.e. on an upper side and on a lower side, the base body is open. This cover opening and this bottom opening, respectively, are closed by a separate cover element or a separate bottom element. For unpacking the bicycle it is thus possible to first remove the cover element. Subsequently, it possible to remove the cubically shaped base body of the bicycle transport packaging such that the heavy bicycle need not be lifted upwards out of the bicycle transport container. Possibly, before removing the cubically shaped base body, individual attachment parts arranged inside the cubically shaped base body, corresponding containers, such as cardboard boxes containing the attachment parts, instruction manuals etc., are to be removed. Further, a front wheel which may not be mounted but is arranged next to the frame inside the cubically shaped base body can first be removed upwards from the cubically shaped base body. Thus, after the removal of the cubically shaped base body, the in particular essentially preassembled bicycle stands on the bottom element and can then easily be removed from the bottom element. Prior to removing the bicycle from the bottom element, the bicycle handlebar etc. can be mounted in this stable position, for example.

However, even the bicycle transport packaging described in DE 20 2018 000 945 is problematic in that when the entire bicycle is preassembled, including a battery, storage over a longer period of time is not desirable for safety reasons. Rather, for safety reasons it preferred to separately store the batteries. However, this is disadvantageous in that the batteries must be separately shipped or the bicycle, together with the battery, can be packed for shipping purposes only immediately before shipment. This is in particular disadvantageous from the logistic point of view.

SUMMARY OF THE INVENTION

An object of the invention to provide a bicycle transport packaging which is in particular suitable for shipping and storing bicycles having an electric drive and a battery.

According to the invention, this object is achieved with a bicycle transport packaging having features as described herein.

The bicycle transport packaging according to the invention comprises a cubically shaped base body. This base body comprises four side elements arranged all around on four sides such that the base body is closed on these four sides. On the remaining two mutually opposite sides the base body is open and thus has a cover opening and a bottom opening. In the usual orientation of a bicycle transport packaging, in particular a transport cardboard box, thus the lower side and the upper side of the base body are open. Here, a transport cardboard box has a base area with a length of 140 cm to 160 cm and a width of 30 cm to 40 cm. The normal height ranges from 80 to 90 cm. The combined length and girth is preferably smaller than 420 cm. The two opposite open sides, i.e. the cover opening and the bottom opening, of the bicycle transport packaging according to the invention are respectively closed by a separate cover element and a separate bottom element, respectively. These are separate elements which are not connected to the base body via folding and/or bending edges. Rather, they are a separate cover element and a separate bottom element. It is particularly preferred that the cover element and the bottom element are of an identical configuration. The two opposite open sides of the base body are closed by the cover element on the one hand and by the bottom element on the other hand.

According to the invention, a reinforcing element is provided in the area of the cover opening. This reinforcing element which is in particular arranged inside the base body can in particular hold the bicycle arranged in the bicycle transport packaging in a particularly safe and reliable manner. In particular, it is possible to store or arrange the bicycle transport packaging together with the partly preassembled bicycle such that the bicycle transport packaging stands on the cover element, i.e. upside down. It is then possible to remove the bottom element such that the bicycle transport packaging is open on its lower side and the bicycle arranged in the bicycle transport packaging is accessible from below. This offers the essential advantage that an area of the bicycle frame in which the battery is arranged, i.e. normally the area of the down tube of the frame, is easily accessible. It is thus possible to completely pack and store the entire bicycle, including accessories, attachment parts, instruction manual etc., except for the battery. The battery can be separately stored such that the corresponding high safety requirements regarding the storage of batteries, in particular in view of the fire hazard, can be complied with in a simple manner.

Immediately before shipping the bicycle transport packaging, the bicycle transport packaging is opened by removing the bottom element on the lower side. Since the down tube of the frame is easily accessible from this side the battery can now be inserted and the bicycle transport packaging can be closed again by the bottom element. Immediately after the insertion of the battery the bicycle transport packaging can be shipped.

The bicycle transport packaging according to the invention thus offers the essential advantage that, except for the battery, a completely packed bicycle can be stored over a longer period of time and the battery can be installed immediately before shipment of the bicycle. Here, it is further advantageous that the battery is directly fixed to the bicycle for transport purposes and no separate fixing and/or packaging of the battery are required. This is very advantageous in view of the weight of the battery. In this manner, a ready-to-use e-bike can be shipped.

According to a particularly preferred embodiment, the reinforcing element is made of cardboard or essentially comprises cardboard.

It is further preferred that the reinforcing element extends over the overall length and/or width of the cover opening of the base body. Thereby, a good reinforcement in the longitudinal and/or transverse direction is realized. In particular, the reinforcing element abuts on opposite inner faces of the side elements of the base body. Here, it is preferred that the reinforcing element abuts on at least the two mutually opposite inner faces of the longitudinal side elements. According to a particularly preferred embodiment, the reinforcing element abuts on all inner faces of the four side elements. It is thus preferred that the reinforcing element has an essentially cubically shaped cross-section. Recesses, indentations or bosses can interfere with a cubically shaped cross-section of the reinforcing element.

Preferably, on a lower side of the reinforcing element a receiving element for the rear wheel is provided. The lower side of the reinforcing element is the side facing inwards towards the packaged bicycle in the closed condition of the bicycle transport packaging. By providing such a receiving element into which in particular an upper portion of the rear wheel extends good fixing of the rear wheel and thus the bicycle frame preferably connected to the rear wheel is realized since it is particularly preferred that the rear wheel is mounted for transport purposes. In particular an upper outer face of the rear wheel abuts on the receiving element such that displacement of the rear wheel during the transport is not possible or possible only within narrow limits.

When the front wheel is mounted a corresponding receiving element can be arranged on the lower side of the reinforcing element. However, it is preferred that the front wheel is not mounted for the transport in order to keep the outer dimensions and thus the combined height and girth of the bicycle transport packaging small.

Even when the front wheel is not mounted it is preferred, according to a preferred aspect of the invention, that a receiving element for the fork stem is arranged on the lower side of the reinforcing element. This receiving element, too, preferably comprises a recess into which the fork stem extends when the bicycle is packaged. Thereby, movement of the fork stem during the transport is prevented or possible only to a small extent.

The reinforcing element is preferably arranged in the cubically shaped base body such that, when the cover element is closed, an inner face of the cover element in particular directly abuts on the upper side of the reinforcing element. Here, the upper side of the reinforcing element is the side opposite the lower side facing towards the cover element. When the cover element is closed the inner face of the cover element faces inwards. According to this preferred embodiment, it is thus ensured that, when the bicycle transport packaging is moved from a position in which the bicycle transport packaging stands on the bottom element into a position in which the bicycle transport packaging stands on the cover element, the bicycle arranged in the bicycle transport packaging does not move or moves only to a small extent.

According to a preferred embodiment, installation of the battery only requires the bicycle transport packaging to be opened via the bottom element. Possibly, a packaging container must be removed which is arranged between the rear wheel and the bicycle fork. This configuration allows for this container to be easily removed from the base body after removal of the bottom element.

Both the cover element and the bottom element each preferably comprise at least two opposite edge elements. The two opposite edge elements partly overlap mutually opposite side elements of the base body. Here, these are preferably the two larger side elements in particular extending in a longitudinal direction of the transport body. Here, the longitudinal direction of the transport body extends in parallel to the two largest mutually opposite side elements of the base body. The longitudinal direction also corresponds to the orientation of the longitudinal direction of the bicycle frame in the bicycle transport packaging.

The overlap of the two opposite edge elements of the cover element as well as the bottom element with the two corresponding side elements of the base body allows for respectively connecting the edge elements to the associated side element via fixing elements. Here, for each edge element one, preferably at least two releasable fixing elements are provided. The fixing elements thus allow for fixedly connecting the separate cover element as well as the separate bottom element to the base body. Since the fixing elements are releasable it is possible in a simple manner to release them for opening the bicycle transport packaging such that the separate cover element can be lifted or separated from the base body in a simple manner, for example. When the cover element has been lifted individual parts, cardboard boxes containing attachment parts, possibly the front wheel to be mounted etc., for example, can be removed from the bicycle transport packaging.

Finally, it is possible, after removing the corresponding fixing element, to lift the base body upwards from the separate bottom element or separate it from the latter. Then the bicycle frame with the mounted rear wheel remains standing on the separate bottom element. It can then be directly assembled or lifted from the bottom element in a simple manner. Thus the bicycle transport packaging according to the invention considerably simplifies the removal of a particularly heavy bicycle, such as an e-bike.

The fixing elements can be separate elements, which are in particular made from a plastic material, for ensuring a reliable connection between the edge elements of the cover and the bottom element and the corresponding side elements of the base body. For this purpose, the edge elements and the corresponding side elements can comprise slots or openings corresponding to each other through which fixing elements are respectively partly inserted and secured by turning, for example.

According to a preferred aspect of the bicycle transport package according to the invention, the separate cover element and/or the separate bottom element are configured such that they respectively comprise four edge elements in particular arranged all around. Thereby, the cover element as well as the bottom element can be easily arranged at a precise position relative to the base body. Here, the edge elements can be configured such that they surround the base body or are arranged inside the base body, wherein surrounding the latter is preferred.

According to a particularly preferred aspect of the bicycle transport packaging, a rear wheel holding element and/or a fork holding element are arranged inside the base body. It is preferred that the bicycle is transported with the front wheel being dismounted as well as preferably the handlebar being dismounted for reducing the dimension of the transport packaging in the longitudinal direction. In particular when the handlebar is dismounted the transverse dimensions can be reduced depending on the turning angle of the handlebar. The front wheel can in particular be arranged next to the frame in the transport packaging.

It is preferred that the rear wheel holding element and/or the fork holding element are configured as separate elements. Here, it is preferred that those as well as possibly the base body, the cover element and the bottom element are made of cardboard. The rear wheel holding element as well as the fork holding element is preferably arranged in the transport packaging such that they rest or are placed upon an inner face of the bottom element. The width of the rear wheel holding element and/or the fork holding element, i.e. the dimension transverse to the longitudinal direction of the transport packaging, preferably essentially corresponds to the internal dimension of the base body in this direction such that good lateral fixing of the rear wheel holding element and/or the fork holding element is realized and thus the bicycle is protected against lateral slipping and thus against damage in the transport packaging. Both the rear wheel holding element and the fork holding element can be composed of a plurality of individual parts, which facilitates the packaging process, for example.

According to a preferred embodiment, the rear wheel holding element is configured such that it comprises a recess for receiving the rear wheel preferably mounted to the bicycle frame. The recess is preferably configured as a vertical slot such that the rear wheel holding element is arranged laterally next to the rear wheel on both sides of the latter. In preferably provided cavities of the rear wheel holding element attachment parts for the bicycle, a battery charger and the like can be arranged for transport purposes.

It is particularly preferred that the rear wheel holding element cooperates with the reinforcing element. In particular, the reinforcing element extends over the overall length of the base body and is thus arranged above the rear wheel holding element or between the rear wheel holding element and the cover element in the packaged condition according to a preferred embodiment. It is further preferred that the rear wheel holding element stands on the bottom element in the packaged condition. Thereby, the rear wheel holding element and thus the rear wheel held by the former are prevented from being displaced when the storing position of the bicycle transport packaging is changed.

In addition, a rear wheel abutment element can be provided inside the base body. The rear wheel abutment element is in particular arranged opposite to the rear wheel holding element in the longitudinal direction such that the rear wheel arranged in the bicycle transport packaging is arranged between these two elements. Thereby, slipping or displacing of the rear wheel and thus the entire bicycle frame in the longitudinal direction is avoided. For this purpose, it is preferred that that the rear wheel abutment element is secured against displacement in the base body. This can be realized by a connection to the base body or the bottom element, for example. In particular, this can further be realized by arranging one or a plurality of further additional elements in the longitudinal direction of the base body, which in particular rest on the inner face of the base body such that in the overall longitudinal direction corresponding elements are arranged in such a manner that slipping of these elements is avoided. The rear wheel abutment element can possibly be omitted or be integrally formed with the intermediate element.

The fork holding element is preferably configured such that it has a width which allows it to be arranged between the drop-out ends of a bicycle fork. Further, it is preferred that the fork holding element comprises one or a plurality of through-going openings or a corresponding slot where the quick-release axle of the front axle can be arranged. With the aid of the quick-release axle the fork holding element can thus be fixed between the dropout ends of the bicycle fork. Here, an element or component connected to the fork holding element or a component integrally formed therewith can have a width corresponding to the internal width of the base body and the bottom element, respectively, such that a lateral displacement in the packaging is avoided. This can also be realized by separate elements arranged next to the fork holding element, for example, such that the elements in total have the corresponding width. The portion of the fork holding element arranged between the two drop-out ends of the bicycle fork is in particular composed of a plurality of layers of cardboard, whereby a large stability can be achieved.

BRIEF DESCRIPTION OF THE DRAWINGS

Hereunder the bicycle transport packaging according to the invention which is in particular suitable for shipping heavy bicycles, such as e-bikes, is explained on the basis of a preferred embodiment with reference to the accompanying figures.

DESCRIPTION OF THE INVENTION

Figure 1:
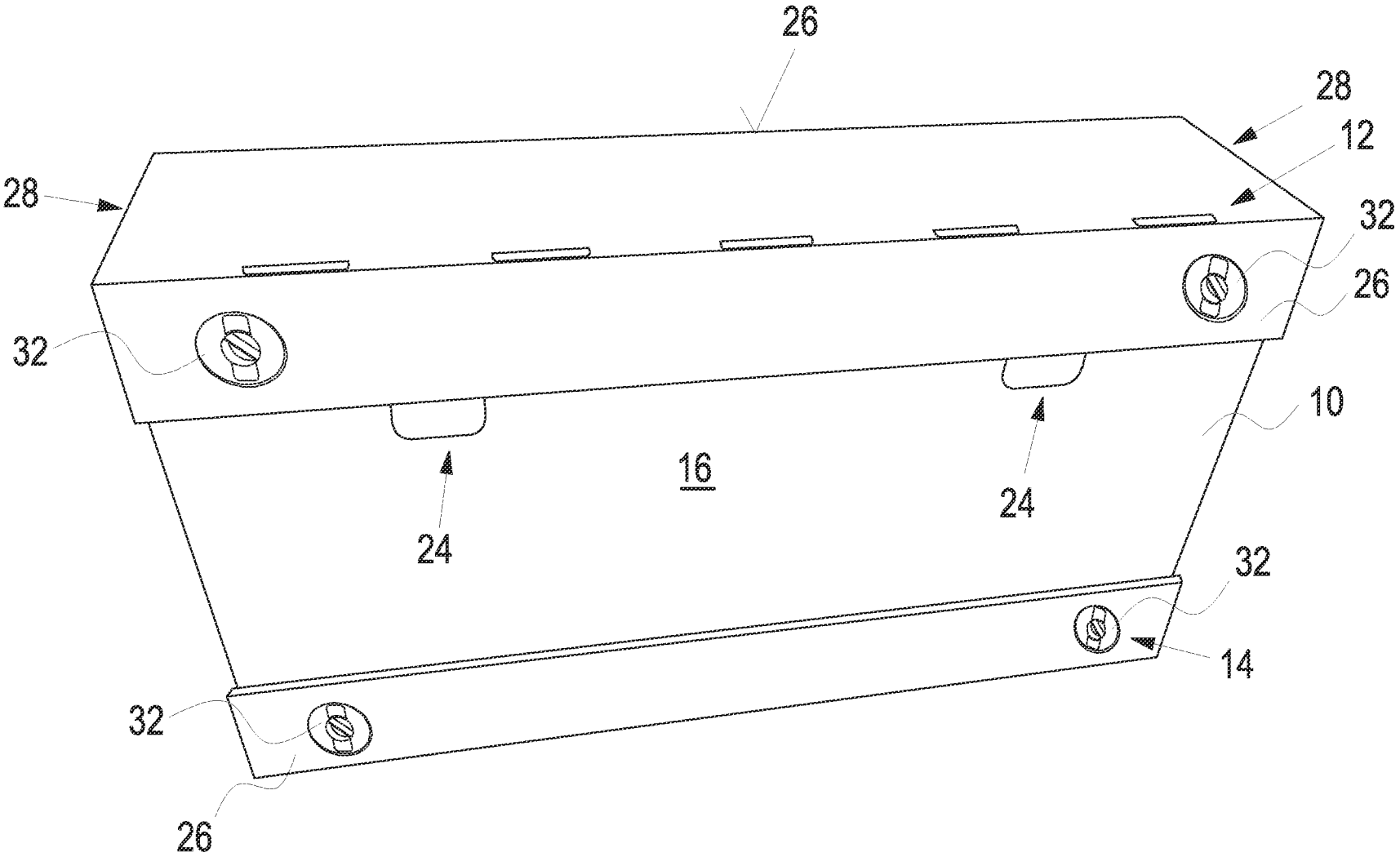
FIG. 1 shows a schematic perspective side view of a closed bicycle transport packaging.
Figure 2:
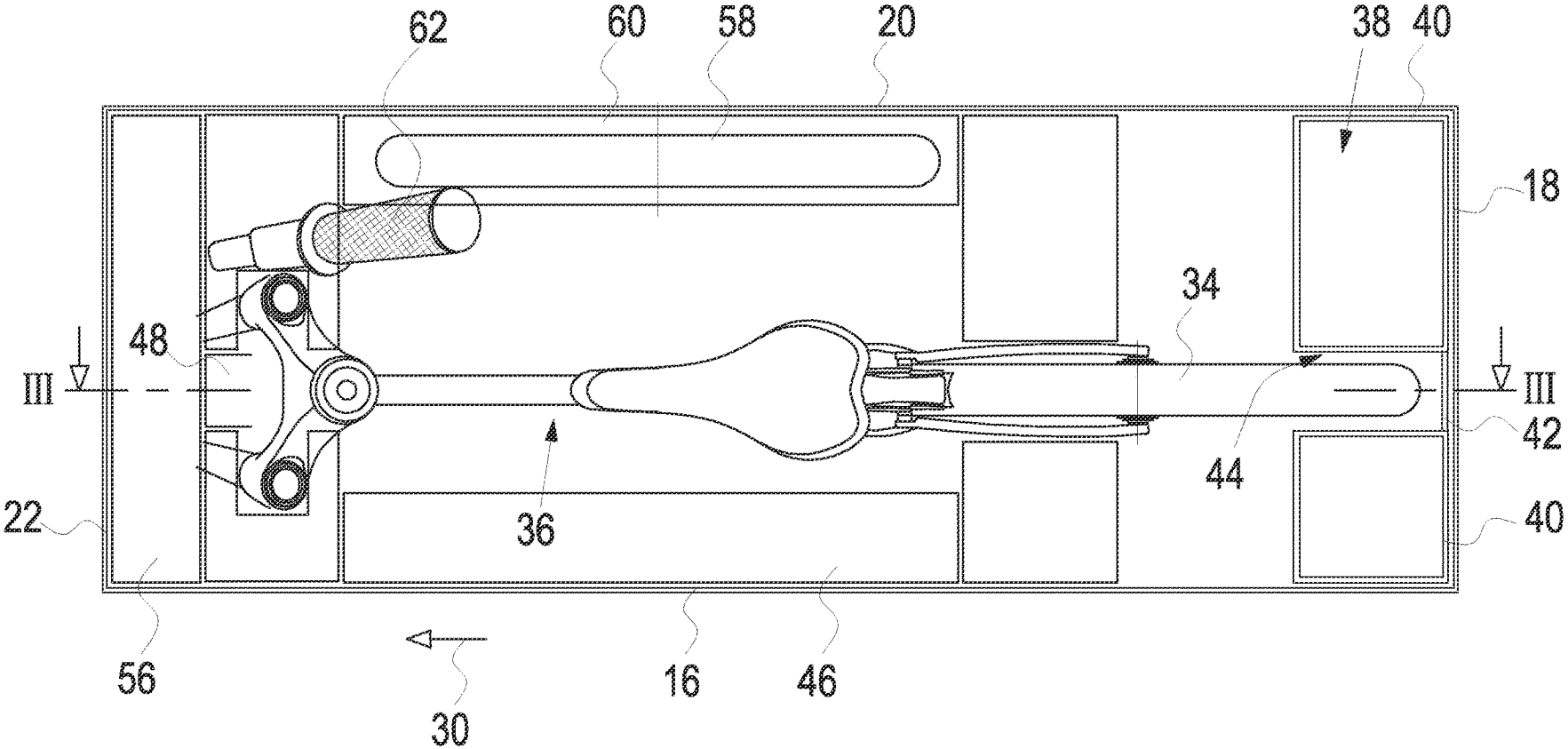
FIG. 2 shows a schematic top view of the bicycle transport packaging with open cover element and upper holding elements already removed from the packaging.

The bicycle transport packaging, shown in FIGS. 1 and 2, preferably made of cardboard comprises a base body 10 which is closed by a cover element 12 on the upper side and a bottom element 14 on the lower side. The base body 10 comprises four side elements 16, 18, 20, 22. These are sides arranged all around the base body 10 such that an essentially cubically shaped base body 10 is formed which is closed on four sides but is open on mutually opposite sides which are adapted to be closed by the cover element 12 and the bottom element 14. The cover element 12 closes a cover opening and the bottom element 14 closes a bottom opening.

For easily carrying the bicycle transport packaging, the two opposite side elements 16, 20 each comprise two grip openings 24 in the illustrated exemplary embodiment. Corresponding grip openings can additionally be provided in the side elements 18 and 22.

The cover element 12 configured as a separate element as well as the correspondingly configured bottom element 14 each comprise four edge elements 26, 28, wherein the two edge elements 26 extend in the longitudinal direction 30 in FIG. 2 of the bicycle cardboard box and are arranged opposite each other. The two edge elements 28 connect the two edge elements 26, extend transversely to the longitudinal direction 30 and are preferably arranged opposite each other.

The bottom element 14 is configured similarly to the cover element 12 and also comprises two opposite edge elements 26 and two opposite edge elements 28.

All edge elements 26, 28 overlap the side elements 16, 18, 20, 22 of the base body 10 essentially over the overall height of the edge elements 26, 28. Thus it is possible to respectively connect the cover element 12 and the bottom element 14 to the base body 10 in a simple manner by providing fixing elements 32. Here, the mutually opposite edge elements 26 of the cover element 12 and the bottom element 14, respectively, are connected to the side elements 16 and 20 of the base body 10. According to a preferred embodiment, the connection is realized by plastic elements which can be fixed and released, respectively, by being turned. By turning the fixing elements 32 by 90 degrees from the position illustrated in FIG. 1, it is possible to pull out or remove the fixing elements 32 sideways. Then there is no longer a connection between the cover element 12 and the base body 10 and between the bottom element 14 and the base body 10, respectively.

It is then possible to remove the cover element 12 of FIG. 1 in an upward direction from the base body 10.

In the next step, holding elements arranged on the upper side or laterally can be removed from the base body 10 and from the packaged bicycle. These serve in particular for fixing the bicycle frame in the area of the rear wheel 34, the bicycle saddle, the steer tube etc. in the longitudinal and/or transverse direction.

In FIG. 2 the bicycle transport packaging is illustrated from above in the open condition, i.e. with the cover element 12 being removed. The holding elements have also already been removed and are thus not illustrated.

A rear wheel 34 which is connected to the rear stay of the bicycle frame 36 is preferably arranged in a rear wheel holding element 38 preferably also made of cardboard. The rear wheel holding element 38 comprises two elements 40 which in particular extend over the overall height of the base body 10 and have an essentially rectangular cross-section, which elements 40 are connected to each other via a web 42. Between the two guiding elements 40 having a rectangular cross-section a vertically extending recess 44 is provided in which the rear wheel 34 is clamped.

In front of the rear wheel 34, as seen in the longitudinal direction 30, a rear wheel abutment element 46 is provided. The rear wheel abutment element 46 which has an essentially triangular cross-section (FIG. 3) serves for preventing the rear wheel 34 and thus and entire bicycle from being displaced forwards in the longitudinal direction 30 in the bicycle transport packaging. The rear wheel abutment element 46 is preferably also made of cardboard.

In addition, a fork holding element 48 is provided inside the base body 10. The former has an essentially rectangular cross-section and is arranged between the two dropout ends 50 of the bicycle fork 52. The bicycle fork 52 is preferably fixed to the fork holding element 48 via a quick-release axle 54 which is inserted into the fork holding element 48 through the corresponding opening 49 of the dropout ends 50 on one hand and through a through-going opening or recess on the other hand. For different frame sizes and thus different wheelbases it is preferred that the fork holding element 48 comprises openings 49 at different positions for receiving the quick-release axle 54.

In addition, an intermediate element 58 is arranged between the fork holding element 48 and the rear wheel abutment element 46. Thereby, power transmission from the rear wheel abutment element 46 to the fork holding element 48 is possible. Thereby, slipping of the bicycle frame 36 in the longitudinal direction 30 is avoided or inhibited. The rear wheel abutment element 46 need not necessarily be connected to the rear wheel holding element 38 via the intermediate element 58 in the longitudinal direction 30 since the corresponding connection is ensured by the rear wheel 34 itself. Further, the abutment element 46 can be omitted or be integrally formed with the intermediate element 58.

In addition, a bicycle handlebar 62 is arranged inside the base body 10. The former is preassembled such that all brake and shifter cables are already connected to the handlebar 62. Further, a front wheel 58 is arranged laterally next to the bicycle frame 36 inside the base body 10. Here, the front wheel 58 is surrounded by a cardboard box 61 for protecting purposes, wherein additional cardboard elements can be provided for protecting a brake disk, for example.

In the packaged condition, a battery 39 is connected to a down tube 37 of the bicycle frame 36. Said battery cooperates with an electric motor, not shown in detail, of the e-bike.

Figure 3:
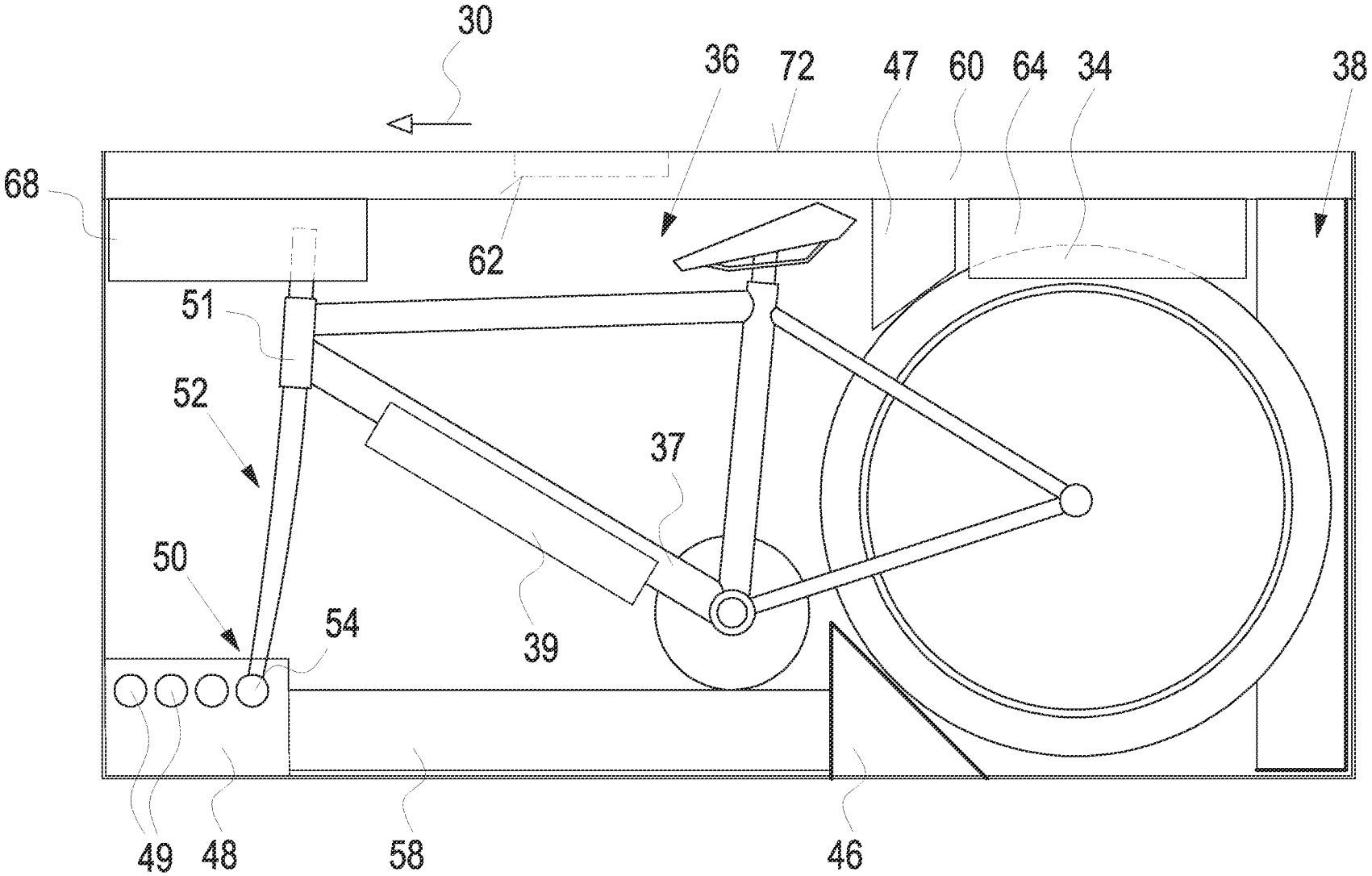
FIG. 3 shows a schematic sectional view as seen in the direction of arrows III-III of FIG. 2.
Figure 4:
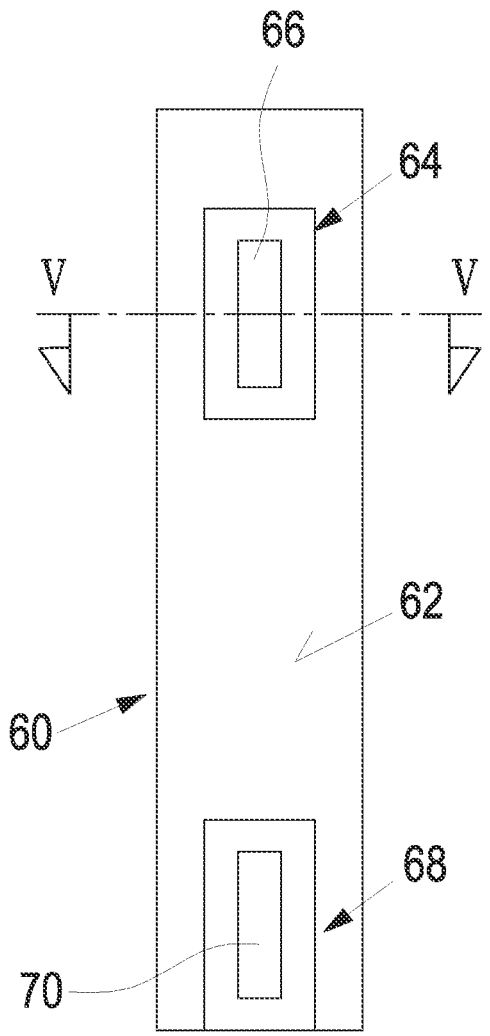
FIG. 4 shows a schematic bottom view of the reinforcing element.
Figure 5:
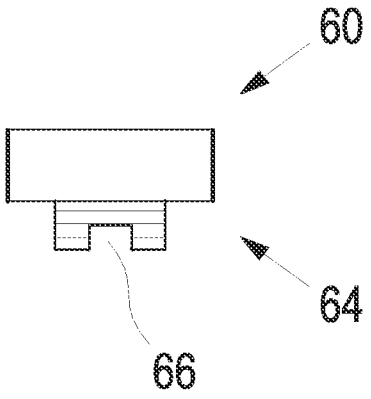
FIG. 5 shows a schematic sectional view of the reinforcing element as seen in the direction of arrow V-V of FIG. 4.

In the upper area of the base body 10 a reinforcing element 60 is arranged. The reinforcing element 60 has a cross-section which at least in a top view is cubicle and extends over the overall length as well as the overall width of the base body 10. On a lower side 62 of the reinforcing element 60 a receiving element 64 is arranged in the area of the rear wheel 34. The receiving element 64 in particular also made of cardboard comprises a recess 66 for receiving the upper portion of the rear wheel 34 (FIG. 3). The receiving element 66 can be composed of several layers of cardboard (FIG. 5).

In the area of the fork stem 51 of the front wheel stem 52 another receiving element 68 is arranged also on the lower side 62 of the reinforcing element 60. Said further receiving element 68 comprises, like the receiving element 64, a recess 70 in which an upper end of the fork stem 51 (FIG. 3) is arranged in the packaged condition. The two receiving elements 64, 68 thus fix the bicycle in the transport packaging. In the closed condition, an upper side 72 of the reinforcing element 60 abuts on an inner face of the cover element 10.

For storing an already packaged e-bike in particular over a longer period of time it is possible to completely package it except for the battery 39. Immediately before the shipment, the battery 39 must be installed. This is realized by the bicycle transport packaging standing on the cover element 10. By releasing the fixing elements 32 the bottom element 14 can be removed. If an intermediate element 58 serving for the transport of individual parts is arranged inside the bicycle transport packaging, said element 58 must also be removed. Then the down tube 37 of the bicycle frame is accessible and the battery 39 can be installed. Subsequently, the possibly provided intermediate element 58 can be placed again into the bicycle transport packaging and the bottom element 14 can be closed. Then the bicycle, together with the mounted battery 39, can be shipped.

The invention claimed is:

1. A bicycle transport packaging, in particular for shipping bicycles having an electric drive, comprising:

a cubically shaped base body which is closed on four sides arranged all around by four side elements and comprises a cover opening and a bottom opening, respectively, on two opposite sides; and a separate cover element closing the cover opening and a separate bottom element closing the bottom opening, wherein a reinforcing element is provided in an area of the cover opening, and wherein the reinforcing element extends over the overall length of the cover opening such that the reinforcing element reinforces at least a portion of the cover element, and wherein the reinforcing element comprises a first receiving element and a second receiving element located on a lower side of the reinforcing element, the first and second receiving elements being located at opposite lengthwise ends of the lower side of the reinforcing element.

2. The bicycle transport packaging according to claim 1, wherein the reinforcing element abuts on opposite inner faces of the side elements of the base body.

3. The bicycle transport packaging according to claim 2, wherein the reinforcing element abuts on all inner faces of the side elements.

4. The bicycle transport packaging according to claim 1, wherein the reinforcing element has an essentially cubical cross-section.

5. The bicycle transport packaging according to claim 1, wherein the first receiving element is designed to receive a rear wheel or an element of a fork stem of a bicycle.

6. The bicycle transport packaging according to claim 1, wherein that, when the cover element is closed, an upper side of the reinforcing element abuts on an inner face of the cover element.

7. The bicycle transport packaging according to claim 1, wherein the reinforcing element comprises recesses for receiving accessories and/or accessories containers.

8. The bicycle transport packaging according to claim 1, wherein the cover element and the bottom element comprise at least two mutually opposite edge elements which at least partly overlap the two mutually opposite side elements of the base body, and the edge elements are respectively connected to an associated side element via at least one releasable fixing element.

9. The bicycle transport packaging according to claim 1, wherein the cover element or the bottom element each comprise four edge elements forming an all-around edge.

10. The bicycle transport packaging according to claim 1, wherein inside the base body, a rear wheel holding element or a fork holding element are arranged.

11. The bicycle transport packaging according to claim 10, wherein the rear wheel holding element and the fork holding element are separate elements.

12. The bicycle transport packaging according to claim 10, wherein the rear wheel holding element comprises a recess for receiving the rear wheel mounted to a bicycle frame.

13. The bicycle transport packaging according to claim 10, wherein the fork holding element has such a width that it is adapted to be arranged between dropout ends of a bicycle fork.

14. The bicycle transport packaging according to claim 13, wherein the fork holding element comprises at least one through-going opening for receiving a quick-release axle.

15. The bicycle transport packaging according to claim 13, wherein the fork holding element comprises several layers of cardboard.

16. The bicycle transport packaging according to claim 10, wherein the rear wheel holding element, a rear wheel abutment element and the fork holding element as well as intermediate elements together have a length corresponding to an internal dimension of the bicycle transport packaging.

17. The bicycle transport packaging according to claim 16, further comprising a front wheel is arranged laterally next to a bicycle frame in the base body.

* * * * *